US008514162B2

(12) United States Patent
Moh et al.

(10) Patent No.: US 8,514,162 B2
(45) Date of Patent: Aug. 20, 2013

(54) DISPLAY APPARATUS INCLUDING VOLTAGE COMPENSATOR TO COMPENSATE COMMON VOLTAGE

(75) Inventors: Sang-Moon Moh, Hwaseong-si (KR); Han-Jin Ryu, Seongnam-si (KR); Hong-Sig Chu, Cheonan-si (KR); Kwang-Jae Kim, Uijeongbu-si (KR); Sang-Don Bae, Seoul (KR); In-Jae Hwang, Cheonan-si (KR); Seung-Hwan Moon, Yongin-si (KR); Sang-Soo Kim, Seoul (KR)

(73) Assignee: Samsung Display Co., Ltd. (KR)

( * ) Notice: Subject to any disclaimer, the term of this patent is extended or adjusted under 35 U.S.C. 154(b) by 440 days.

(21) Appl. No.: 12/609,550

(22) Filed: Oct. 30, 2009

(65) Prior Publication Data

US 2010/0110058 A1 May 6, 2010

(30) Foreign Application Priority Data

Oct. 30, 2008 (KR) ..... 10-2008-0107237

(51) Int. Cl.
*G09G 3/36* (2006.01)

(52) U.S. Cl.
USPC ..... 345/94

(58) Field of Classification Search
USPC ..... 345/87–104, 613, 694–696
See application file for complete search history.

(56) References Cited

U.S. PATENT DOCUMENTS

| | | | | |
|---|---|---|---|---|
| 2003/0006978 | A1* | 1/2003 | Fujiyoshi | 345/204 |
| 2006/0001638 | A1* | 1/2006 | Jeon et al. | 345/100 |
| 2006/0050029 | A1* | 3/2006 | Toyoda et al. | 345/76 |
| 2006/0066535 | A1* | 3/2006 | Shirasaki et al. | 345/76 |
| 2006/0170640 | A1 | 8/2006 | Okuno | |
| 2006/0244704 | A1* | 11/2006 | JaeHun | 345/92 |
| 2007/0013706 | A1* | 1/2007 | Kodaira et al. | 345/545 |
| 2007/0024560 | A1* | 2/2007 | Kim et al. | 345/94 |
| 2007/0024565 | A1* | 2/2007 | Choi | 345/98 |
| 2008/0030667 | A1* | 2/2008 | Lee | 349/150 |
| 2009/0015528 | A1* | 1/2009 | Sheu | 345/87 |
| 2009/0102777 | A1* | 4/2009 | Izumikawa et al. | 345/96 |
| 2009/0128466 | A1* | 5/2009 | Chung et al. | 345/87 |

FOREIGN PATENT DOCUMENTS

| | | | |
|---|---|---|---|
| CN | 1409292 | A | 4/2003 |
| CN | 1904992 | A | 1/2007 |
| CN | 1908741 | A | 2/2007 |
| CN | 101118329 | A | 2/2008 |
| EP | 1884915 | | 2/2008 |
| JP | 06186530 | A | 7/1994 |
| JP | 08005989 | A | 1/1996 |

(Continued)

*Primary Examiner* — Chanh Nguyen
*Assistant Examiner* — Sanghyuk Park
(74) *Attorney, Agent, or Firm* — Cantor Colburn LLP

(57) ABSTRACT

A display apparatus includes; a data driver integrated in one chip and which outputs data signals; a gate driver which sequentially outputs gate signals, a display panel which includes; a plurality of data lines which receive the data signals, a plurality of gate lines which receive the gate signals, and a plurality of pixels connected to a corresponding gate line and a corresponding data line, a voltage generator which generates a common voltage and a storage voltage and provides them to the display panel, and a voltage compensator which receives the storage voltage fedback from the display panel and generates a compensation signal, wherein the display panel further includes a feedback line which provides the voltage compensator with the storage voltage, and wherein the feedback line is electrically connected to the voltage compensator through the data driver.

21 Claims, 11 Drawing Sheets

(56) References Cited

FOREIGN PATENT DOCUMENTS

| | | | |
|---|---|---|---|
| JP | 2001194645 | | 7/2001 |
| JP | 2002244580 | A | 8/2002 |
| JP | 2002311849 | A | 10/2002 |
| JP | 2007213063 | A | 8/2007 |
| KR | 100280874 | | 11/2000 |
| KR | 1020060000232 | | 1/2006 |
| KR | 1020060012193 | | 2/2006 |
| KR | 1020060077951 | | 7/2006 |
| KR | 1020070070748 | | 7/2007 |

* cited by examiner

DISPLAY APPARATUS INCLUDING VOLTAGE COMPENSATOR TO COMPENSATE COMMON VOLTAGE

This application claims priority to Korean Patent Application No. 2008-107237, filed on Oct. 30, 2008, and all the benefits accruing therefrom under 35 U.S.C. §119, the contents of which in its entirety are herein incorporated by reference.

BACKGROUND OF THE INVENTION

1. Field of the Invention

The present invention relates to a display apparatus. More particularly, the present invention relates to a display apparatus capable of improving display quality by preventing crosstalk.

2. Description of the Related Art

A liquid crystal display applies an electric field between two substrates to change an orientation of a liquid crystal layer disposed between the two substrates and thereby adjust an amount of light passing through the two substrates, in order to display desired images.

To this end, typically a lower substrate of the two substrates includes gate lines, data lines, and pixels, and an upper substrate of the two substrates includes a common electrode applied with a common voltage. When the gate lines are sequentially driven, data voltages are applied to the pixels through the data lines.

Since liquid crystals may be deteriorated when an electric field having a fixed direction is repeatably applied thereto, the liquid crystal display typically adopts an inversion driving scheme to invert polarities of the data voltages with respect to a polarity of the common voltage.

In a display including the inversion driving scheme, a coupling occurs between the common voltage and the data voltage. Particularly, since the common voltage is a direct current voltage, a ripple occurs in the common voltage when the data voltages rise or fall. The ripple in the common voltage exerts influences on a liquid crystal capacitor in each pixel, and thus a crosstalk occurs in the liquid crystal display, thereby causing deterioration in image quality.

BRIEF SUMMARY OF THE INVENTION

Exemplary embodiments of the present invention provide a display apparatus capable of removing ripple to improve a quality of a displayed image by removing or compensating for crosstalk.

In an exemplary embodiment of the present invention, a display apparatus includes; a data driver which outputs data signal, a gate driver which sequentially outputs gate signal, a display panel including; a data line which receives the data signal, a gate line which receives the gate signal, and a pixel which is connected to the gate line and the data line, a voltage generator which generates a common voltage and a storage voltage and provides the display panel with the common voltage and the storage voltage, a voltage compensator which receives the storage voltage fedback from the display panel and generates a compensation signal to compensate the common voltage based on the fedback storage voltage, and a feedback line which provides the voltage compensator with the storage voltage, and the feedback line electrically connected to the voltage compensator through the data driver.

In another exemplary embodiment of the present invention, a display apparatus includes; a data driver which is integrated in a chip and which outputs data signals, a gate driver which sequentially outputs gate signals, a display panel including; a plurality of data lines which receive the data signals, a plurality of gate lines which receive the gate signals, and a plurality of pixels each of which is connected to a corresponding the gate line of the plurality of gate lines and a corresponding data line of the plurality of data lines, a voltage generator which generates a common voltage and a storage voltage and provides the display panel with the common voltage and the storage voltage, a voltage compensator which receives the storage voltage fedback from the display panel and generates a compensation signal to compensate the common voltage based on the fedback storage voltage, and a feedback line which provides the voltage compensator with the storage voltage, and the feedback line electrically connected to the voltage compensator through the data driver, wherein the plurality of gate lines extend in a first direction, the plurality of data line extend in a second direction substantially perpendicular to the first direction, the display panel has a structure wherein a length thereof in the first direction is longer than a length thereof in the second direction, and a number of the plurality of gate lines is more than a number of the plurality of data lines.

In another exemplary embodiment of the present invention, a display apparatus includes; a data driver which is integrated in a chip and which outputs data signals, a gate driver which sequentially outputs gate signals, a display panel including; a plurality of data lines which receive the data signals, a plurality of gate lines which receive the gate signals, and a plurality of pixels each of which is connected to a corresponding the gate line of the plurality of gate lines and a corresponding data line of the plurality of data lines, a voltage generator which generates a common voltage and a storage voltage and provides the display panel with the common voltage and the storage voltage, a voltage compensator which receives the storage voltage fedback from the display panel and generates a compensation signal to compensate the common voltage based on the fedback storage voltage, and a feedback line which provides the voltage compensator with the storage voltage, and the feedback line electrically connected to the voltage compensator through the data driver, wherein the plurality of gate lines extend in a first direction, the plurality of data line extend in a second direction substantially perpendicular to the first direction, the display panel has a structure wherein a length thereof in the second direction is longer than a length thereof in the first direction, and a number of the plurality of gate lines is more than a number of the plurality of data lines.

According to the above, the voltage compensator receives the storage voltage fedback from the storage line arranged in the liquid crystal display panel and generates the compensation signal to compensate for the common voltage. Thus, crosstalk caused by a ripple in the common voltage may be removed, thereby improving image display quality.

BRIEF DESCRIPTION OF THE DRAWINGS

The above and other aspects, advantages, and features of the invention will become more readily apparent by describing in further detail exemplary embodiments thereof with reference to the attached drawings, in which.

DESCRIPTION OF THE INVENTION

Figure 1:
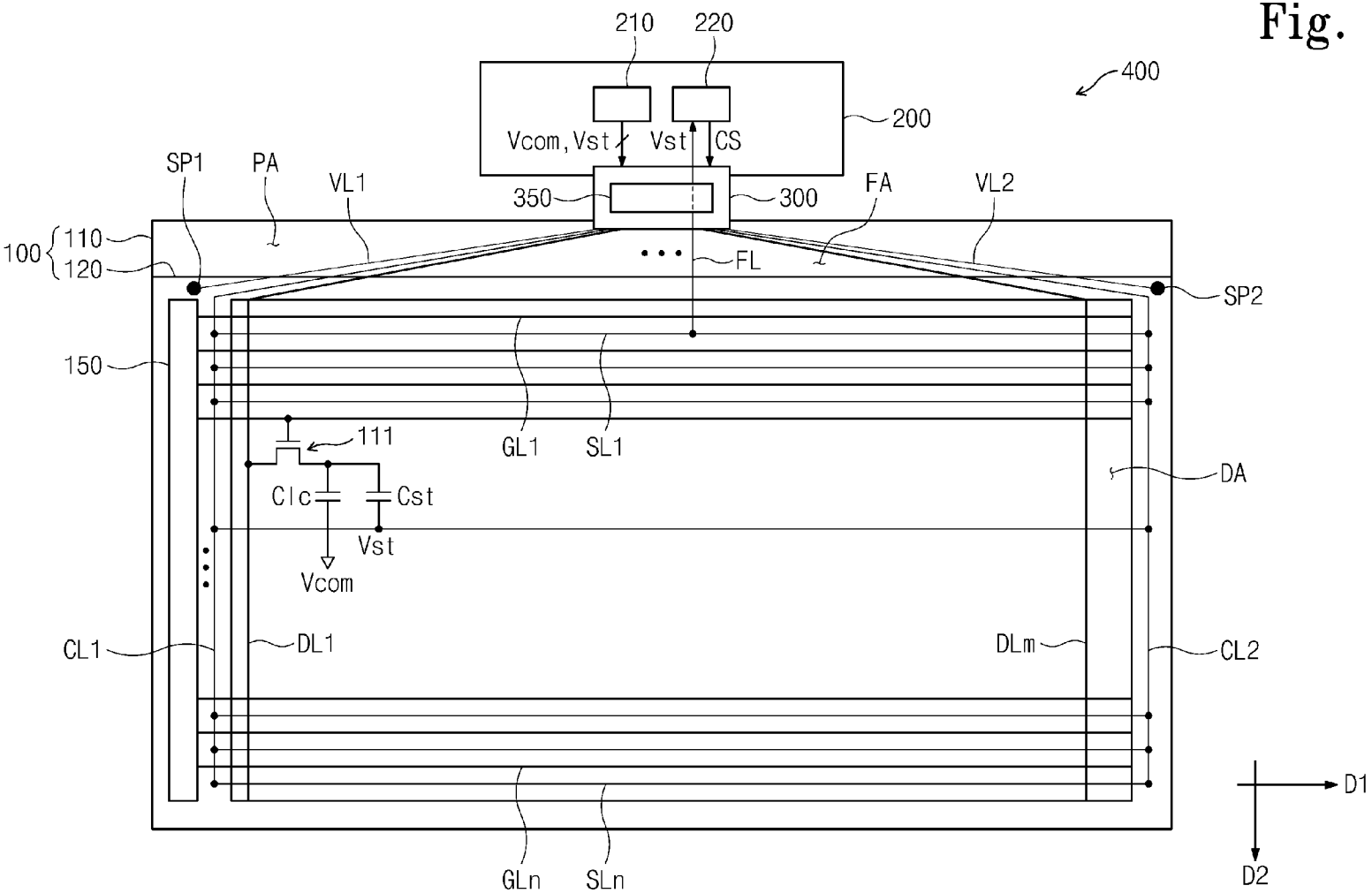
FIG. 1 is a top plan view illustrating an exemplary embodiment of a liquid crystal display according to the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be explained in detail with reference to the accompanying drawings.

FIG. 1 is a top plan view illustrating an exemplary embodiment of a liquid crystal display according to the present invention.

Referring to FIG. 1, a liquid crystal display 400 includes a liquid crystal display panel 100, a printed circuit board 200 adjacent to the liquid crystal display panel 100, and a flexible printed circuit film 300 that electrically connects the liquid crystal display panel 100 to the printed circuit board 200.

The liquid crystal display panel 100 includes an array substrate 110, a color filter substrate 120 facing the array substrate 110, and a liquid crystal layer (not shown) interposed between the array substrate 110 and the color filter substrate 120. The array substrate 110 is divided into a display area DA displaying an image and a peripheral area PA surrounding the display area DA. In one exemplary embodiment the peripheral area PA substantially surrounds the entire display area DA.

In the present exemplary embodiment, pixels are arranged in a matrix configuration in the display area DA of the array substrate 110. More particularly, a plurality of gate lines GL1~GLn, a plurality of data lines DL1~DLm, and a plurality of storage lines SL1~SLn are arranged in the display area DA. The gate lines GL1~GLn extend in a first direction D1 and are arranged to have a substantially uniform interval along a second direction D2, which is substantially perpendicular to the first direction D1. The data lines DL1~DLm extend in the second direction D2 and are arranged in the first direction with a substantially uniform interval. In the present exemplary embodiment, the data lines DL1~DLm are arranged on a different layer from the gate lines GL1~GLn, and the data lines DL1~DLm are insulated from and cross over the gate lines GL1~GLn. However, alternative exemplary embodiments include configurations wherein the data lines and gate lines may have other arrangements. In the present exemplary embodiment, the storage lines SL1~SLn are arranged in a same layer as the gate lines GL1~GLn and extend in the first direction D1 and are arranged to have a substantially uniform interval along the second direction D2. In the present exemplary embodiment, each storage line is arranged between two gate lines adjacent to each other.

Pixel areas may be surrounded by the gate lines GL1~GLn and the data lines DL1~DLm in the display area DA. Each pixel area includes a pixel, and the pixel includes a thin film transistor 111, a pixel electrode that serves as a first electrode of a liquid crystal capacitor Clc, and a storage capacitor Cst. In the present exemplary embodiment, a storage voltage Vst is applied to the storage lines SL1~SLn, and each of the storage lines SL1~SLn overlaps a corresponding pixel electrode to form the storage capacitor Cst.

In the present exemplary embodiment, a first connection line CL1 and a second connection line CL2 are arranged in the peripheral area PA to connect the storage lines SL1~SLn to each other. The first connection line CL1 connects first ends of the storage lines SL1~SLn to each other, and the second connection line CLC2 connects second ends of the storage lines SL1~SLn to each other. The first and second connection lines CL1 and CL2 receive the storage voltage Vst and provide the storage lines SL1~SLn with the storage voltage Vst.

Although not shown in FIG. 1, in the present exemplary embodiment, the color filter substrate 120 includes a color filter and a common electrode. In the present exemplary embodiment, the color filter includes a red color pixel, a green color pixel, and a blue color pixel, although alternative exemplary embodiments may include other colors. In the present exemplary embodiment, the common electrode is formed on substantially an entire surface of the color filter substrate 120 and faces the pixel electrode to form the liquid crystal capacitor Clc, although alternative exemplary embodiments include configurations wherein the common electrode includes cutouts or various other voids to not cover the entire surface of the color filter substrate 120. A common voltage Vcom is applied to the common electrode. Alternative exemplary embodiments also include configurations wherein the color filter may be formed on the array substrate 110.

In order to provide the common electrode with the common voltage Vcom, a first common voltage line VL1 and a second common voltage line VL2 are arranged in the array substrate 110 to receive the common voltage Vcom. The first common voltage line VL1 is electrically connected to the common electrode at a first short point SP1, and the second common voltage line VL2 is electrically connected to the common electrode at a second short point SP2. Alternative exemplary embodiments include configurations wherein the number and location of short points may be varied; specifically one exemplary embodiment includes configurations wherein additional short points may be included.

Although not shown in FIG. 1, a conductive spacer is arranged at the first and second short points SP1 and SP2. More particularly, the conductive spacer is arranged between the first common voltage line VL1 and the common electrode and between the second common voltage line VL2 and the common electrode to electrically connect the first and second common voltage lines VL1 and VL2 to the common electrode. Thus, the common voltage Vcom applied to the first and second common voltage lines VL1 and VL2 may be provided to the common electrode via the conductive spacer.

As an exemplary embodiment of the present invention, the liquid crystal display panel 100 has a rectangular shape in which a length thereof in the first direction D1 is longer than a length thereof in the second direction D2, and a number of the gate lines GL1~GLn is more than a number of the data lines DL1~DLm. In the present exemplary embodiment, each pixel has a shape in which a length thereof in the first direction D1 is longer than a length thereof in the second direction D2. However, alternative exemplary embodiments may include liquid crystal displays having various shapes with pixels also having various shapes.

The liquid crystal display 400 further includes a gate driver 150 and a data driver 350. In the present exemplary embodiment, the gate driver 150 includes a plurality of amorphous silicon type transistors, and the gate driver 150 is directly formed on the array substrate 110, e.g., through a thin film process. The gate driver 150 is arranged adjacent to a shorter side of the liquid crystal display panel 100 and is electrically connected to the gate lines GL1~GLn. Thus, the gate driver 150 sequentially applies a gate signal to the gate lines GL1~GLn to sequentially scan the pixels in a pixel row along the shorter side of the liquid crystal display panel 100.

In the present exemplary embodiment, the data driver 350 is integrated in one chip and mounted on the flexible printed circuit film 300. The data driver 350 (hereinafter, referred to as a driver integrated circuit ("IC")) is arranged adjacent to a longer side of the liquid crystal display panel 100 and electrically connected to the data lines DL1~DLm to apply a data signal thereto.

The printed circuit board 200 is arranged adjacent to the longer side of the liquid crystal display panel 100 and electrically connected to the liquid crystal display panel 100 through the flexible printed circuit film 300. More particularly, a first end portion of the flexible printed circuit film 300 is attached to the peripheral area PA of the liquid crystal display panel 100, and a second end portion of the flexible printed circuit film 300 is attached to the printed circuit board 200. Therefore, signals output from the printed circuit board 200 are applied to the driver IC 350 or the gate driver 150 on the liquid crystal display panel 100 through the flexible printed circuit film 300.

Meanwhile, a fan-out area FA is formed in the peripheral area PA, in which the data lines DL1~DLm are arranged to branch from the flexible printed circuit film 300 and extend in the display area DA. The first connection line CL1 is arranged in a left side outside the fan-out area FA, and the second connection line CL2 is arranged in a right side outside the fan-out area FA. The first and second common voltage lines VL1 and VL2 are arranged adjacent to the first and second connection lines CL1 and CL2, respectively, outside the fan-out area FA. The first and second connection lines CL1 and CL2 are insulated from the first and second common voltage lines VL1 and VL2.

The liquid crystal display 400 further includes a voltage generator 210 to generate the storage voltage Vst and the common voltage Vcom and a voltage compensator 220 to generate a compensation signal CS that compensates for the common voltage Vcom. In the present exemplary embodiment, the voltage generator 210 and the voltage compensator 220 are arranged in the printed circuit board 200.

The storage voltage Vst output from the voltage generator 210 is applied to the first and second connection lines CL1 and CL2 arranged in the liquid crystal display panel 100 via the flexible printed circuit film 300, and the common voltage Vcom is applied to the first and second common voltage lines VL1 and VL2 arranged in the liquid crystal display panel 100 via the flexible printed circuit film 300. In the present exemplary embodiment, the storage voltage Vst and the common voltage Vcom are direct current ("DC") voltages and have different voltage levels from each other. However, alternative exemplary embodiments include configurations wherein the storage voltage Vst and the common voltage Vcom may have the same voltage level or may be alternating current ("AC") voltages.

The voltage compensator 220 receives the storage voltage Vst from the liquid crystal display panel 100 to extract a ripple component included in the storage voltage Vst and provides the liquid crystal display panel 100 with the compensation signal CS which has a phase substantially opposite to a phase of the ripple component.

The compensation signal CS may be applied to the first and second common voltage lines VL1 and VL2, and the compensation signal CS may be applied to the first and second connection lines CL1 and CL2. In the present exemplary embodiment, the ripple component in the storage voltage Vst and the ripple component in the common voltage Vcom are similar in shape to each other. Thus, the compensation signal CS having the phase opposite to the phase of the ripple component of the storage voltage Vst may remove the ripple component generated in the common voltage Vcom and the storage voltage Vst of the liquid crystal display panel 100.

The liquid crystal display panel 100 further includes a feedback line FL to feedback the storage voltage Vst applied to the storage lines SL1~SLn to the voltage compensator 220.

In the present exemplary embodiment, the feedback line FL branches from a first storage line SL1 that is most adjacent to the flexible printed circuit film 300 among the storage lines SL1~SLn, although alternative exemplary embodiments include configurations wherein the feedback line FL branches from a subsequent storage line SL. The feedback line FL branched from the first storage line SL1 extends to the voltage compensator 220 arranged on the printed circuit board 200 via the flexible printed circuit film 300 after passing through the fan-out area FA. As a result, the feedback line FL may provide the voltage compensator 220 with the storage voltage Vst of the liquid crystal display panel 100.

Figure 2:
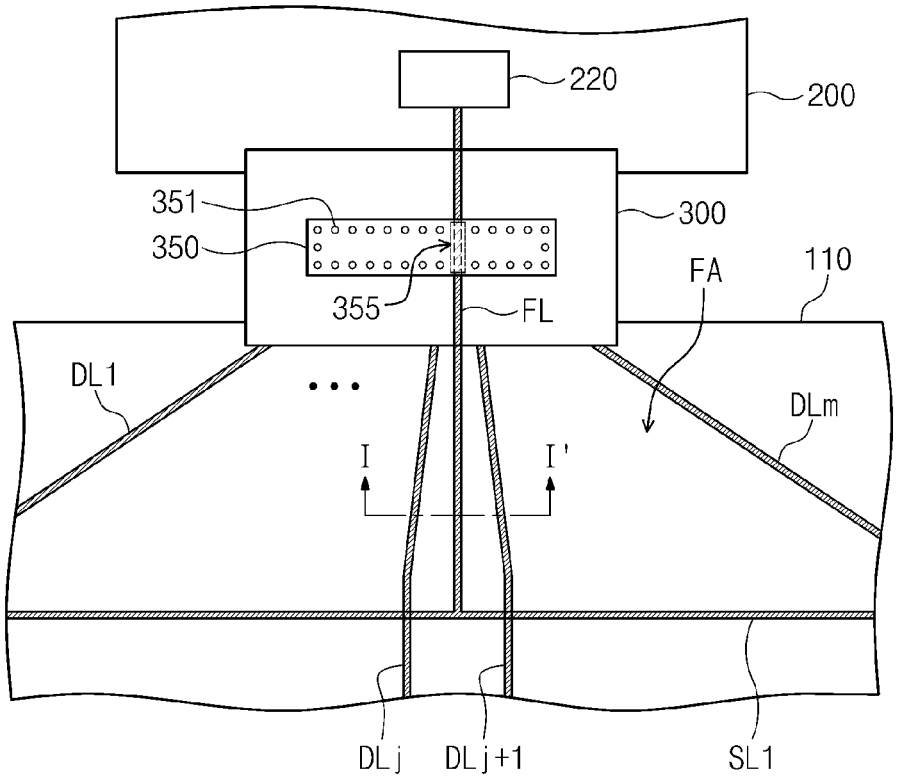
FIG. 2 is an enlarged view illustrating a path of a feedback line of FIG. 1.
Figure 3:
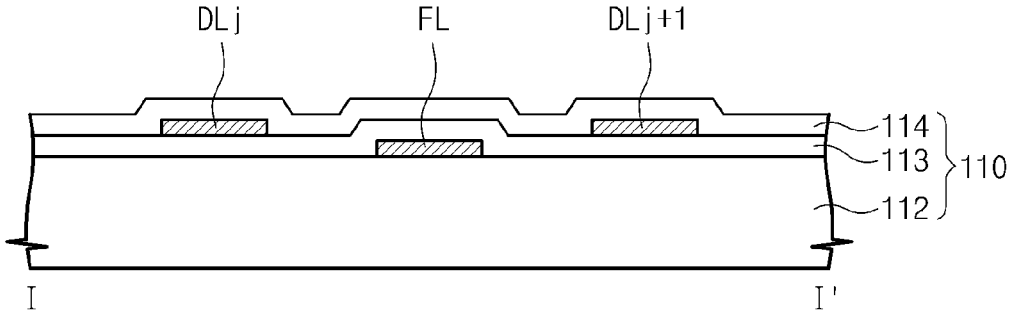
FIG. 3 is a cross-sectional view taken along line I-I' of FIG. 2.

FIG. 2 is an enlarged view illustrating a path of the feedback line of FIG. 1, and FIG. 3 is a cross-sectional view taken along line I-I' of FIG. 2.

Referring to FIGS. 2 and 3, the feedback line FL branches from the first storage line SL1 and passes through the fan-out area FA. In one exemplary embodiment, the first storage line SL1 includes substantially the same material as the gate lines GL1~GLn and is arranged on a base substrate 112 of the array substrate 110. In one exemplary embodiment, the feedback line FL includes substantially the same material as the first storage line SL1 and is arranged on the base substrate 112.

Although not shown in FIGS. 2 and 3, in an exemplary embodiment that a gate line (a first gate line GL1) is formed in a path of the feedback line FL, a bridge structure may be employed to prevent an electrical connection between the first gate line GL1 and the feedback line FL. In the bridge structure, the feedback line FL may be divided in an area, in which the first gate line GL1 is formed, into feedback lines, and the divided feedback lines may be electrically connected to each other through a bridge electrode formed on a different layer from a layer on which the first gate line GL1 is formed.

Meanwhile, the data lines DL1~DLm are arranged in the fan-out area FA. The data lines DL1~DLm are arranged on an insulating layer 113 covering the feedback line FL. Thus, the feedback line FL is insulated from the data lines DL1~DLm by the insulating layer 113. A protective layer 114 protects the data lines DL1~DLm.

In FIGS. 2 and 3, an exemplary embodiment having a structure wherein the feedback line FL includes the same material as the first storage line SL1 and is arranged on the base substrate 112 has been shown. However, alternative exemplary embodiments include configurations wherein the feedback line FL may include the same material as the data lines DL1~DLm and be arranged on the insulating layer 113.

The feedback line FL extends to the printed circuit board 200 on the flexible printed circuit film 300. The flexible printed circuit film 300 is provided with an IC mount area on which the driver IC 350 is mounted. In the present exemplary embodiment, the feedback line FL passes through the IC mount area. A plurality of input and output terminals 351 is provided on a lower surface of the driver IC 350. In addition, a blank area 355 in which the input and output terminals 351 are not arranged is formed in the IC mount area corresponding to the path of the feedback line FL. Thus, the input and output terminals 351 may be prevented from being electrically short-circuited with the feedback line FL.

The feedback line FL extends to the printed circuit board 200 via the flexible printed circuit film 300 and is electrically connected to the voltage compensator 220 arranged on the printed circuit board 200. Thus, the voltage compensator 220 may receive the storage voltage Vst of the liquid crystal display panel 100 and generate the compensation signal CS based on the storage voltage Vst. More detailed descriptions about the voltage compensator 220 will be described with reference to FIGS. 6 and 7.

Figure 4:
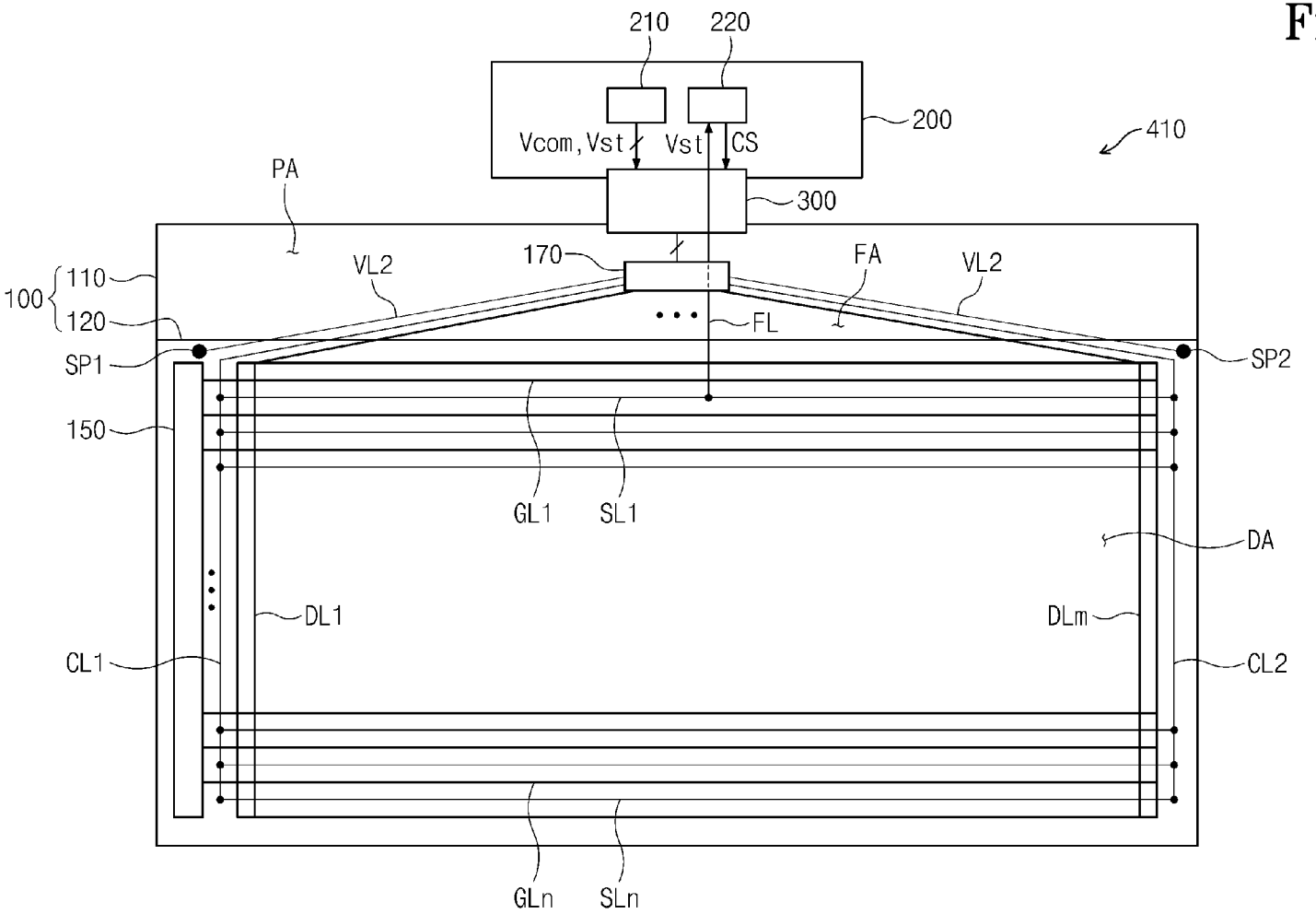
FIG. 4 is a top plan view illustrating another exemplary embodiment of a liquid crystal display according to the present invention.
Figure 5:
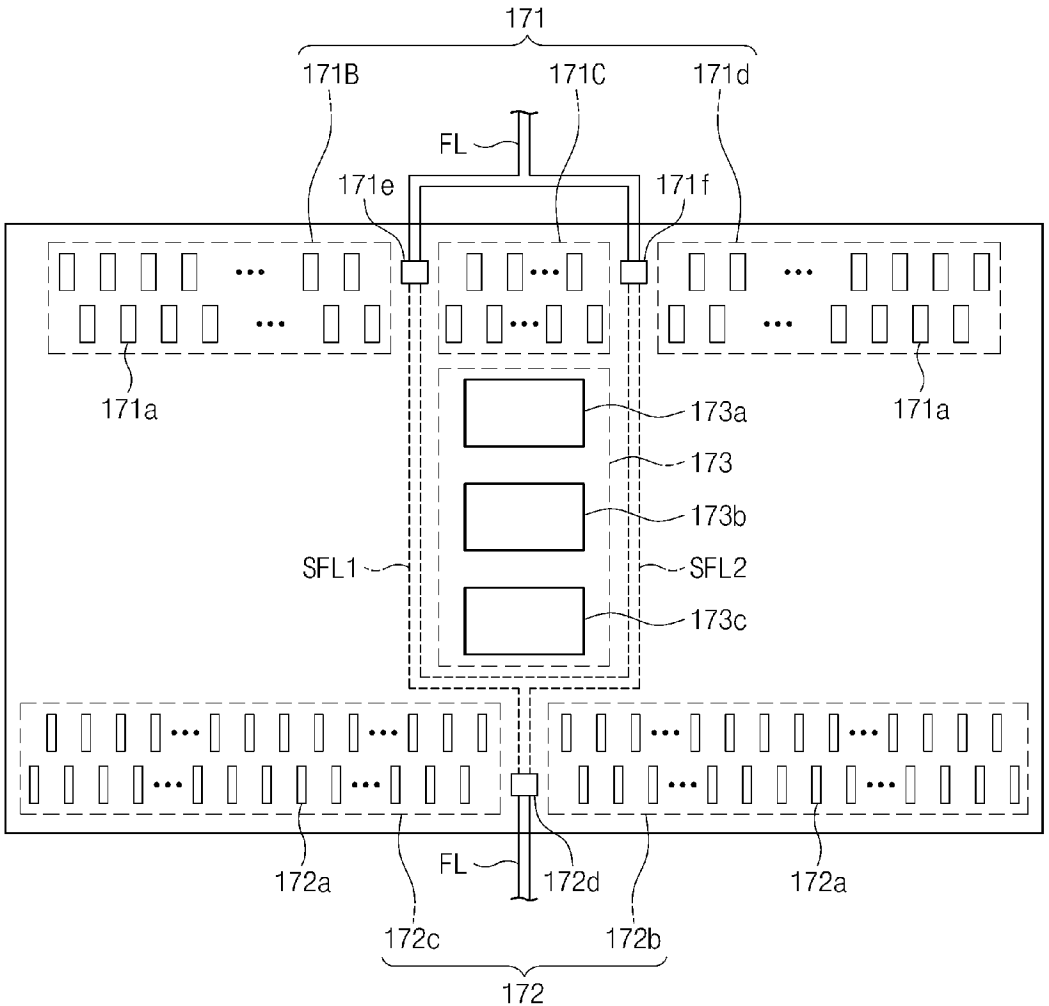
FIG. 5 is a block diagram illustrating a driver IC of FIG. 4.

FIG. 4 is a top plan view illustrating another exemplary embodiment of a liquid crystal display according to the present invention, and FIG. 5 is a block diagram illustrating a driver IC of FIG. 4. In FIG. 4, the same reference numerals denote the same elements in FIG. 1, and thus the detailed descriptions of the same elements will be omitted.

Referring to FIG. 4, in a liquid crystal display 410, a data driver is integrated in one driver IC and mounted on a peripheral area PA of a liquid crystal display panel 100.

A fan-out area FA is provided between the driver IC 170 and the display area DA, and a feedback line FL withdrawn from the display area DA extends to a printed circuit board 200 via a flexible printed circuit film 300 after passing through the fan-out area FA and the driver IC 170. Thus, the feedback line FL branched from a first storage line SL1 in the display area DA may provide a voltage compensator 220 arranged on the printed circuit board 200 with a storage voltage Vst.

As illustrated in FIG. 5, the driver IC 170 includes an input part 171 adjacent to the flexible printed circuit film 300 (shown in FIG. 4), an output part 172 adjacent to the display area DA of the liquid crystal display panel 100, and a center block 173 interposed between the input part 171 and the output part 172. In the present exemplary embodiment, the center block 173 includes a receiver 173*a*, a timing controller 173*b*, and a data driver 173*c*.

The input part 171 includes a plurality of input terminals 171*a* arranged on a lower surface of the driver IC 170 and spaced apart from each other by a predetermined distance, and the output part 172 includes a plurality of output terminals 172*a* arranged on the lower surface of the driver IC 170 and spaced apart from each other by a predetermined distance. In the present exemplary embodiment, the driver IC 170 has a rectangular-like shape, although alternative exemplary embodiments include configurations wherein the driver IC 170 has other shapes. In the present exemplary embodiment, the input terminals 171*a* are arranged adjacent to one longer side of the driver IC 170, and the output terminals 172*a* are arranged adjacent to the other longer side of the driver IC 170.

In the present exemplary embodiment, the output part 172 is divided into two groups 172*b* and 172*c*, and a first feedback terminal 172*d* is arranged between the two groups. Also, the input part 171 is divided into three groups 171*b*, 171*c*, and 171*d*, and a second feedback terminal 171*e* and a third feedback terminal 171*f* are arranged between two adjacent groups of the input part 171, respectively. In general, since a number of signals output from the driver IC 170 is much more than a number of signals input to the driver IC 170, a number of output terminals 172*a* is much more than a number of the input terminals 171*a*. Thus, in the present exemplary embodiment only one feedback terminal 172*d* is arranged in the output part 172, however, two feedback terminals 171*e* and 171*f* may be arranged in the input part 171. Alternative exemplary embodiments include configurations wherein a plurality of feedback terminals is included on either the input part 171 or the output part 172.

The first feedback terminal 172*d* is electrically connected to the feedback line FL extended from the display area DA of the liquid crystal display panel 100, and the second and third feedback terminals 171*e* and 171*f* are electrically connected to the feedback line FL extended to the flexible printed circuit film 300 on the liquid crystal display panel 100.

A first sub-feedback line SFL1 and a second sub-feedback line SLF2 are arranged in the driver IC 170 to electrically connect the first feedback terminal 172*d* to the second and third feedback terminals 171*e* and 171*f*. In the present exemplary embodiment, the first and second sub-feedback lines SFL1 and SFL2 extended from the second and third feedback terminals 171*e* and 171*f*, respectively, are arranged adjacent to the center block 173 substantially in parallel with each other while interposing the center block 173 therebetween, and the first and second sub-feedback lines SFL1 and SFL2 are combined with each other in the output part 172 to be commonly connected to the first feedback terminal 172*d*. As a result, the first and second sub-feedback lines SFL1 and SLF2 are prevented from being overlapped with the center block 173, and thus the center block 173 may be prevented from being affected by a ripple of the storage voltage Vst transmitted through the feedback line FL.

In the exemplary embodiment wherein the driver IC 170 is mounted on the liquid crystal display panel 100, the feedback line FL is formed to pass through the driver IC 170, so that the feedback line FL may be prevented from being electrically short-circuited with various lines passing through an area where the driver IC 170 is mounted.

In FIG. 5, the receiver 173*a* receives various signals in a low voltage differential signaling ("LVDS") interface from an external device to provide the timing controller 173*b* with the various signals.

In the present exemplary embodiment, the timing controller 173*b* outputs a gate control signal, a data control signal, and an image data (not shown). The data driver 173*c* receives the data control signal and the image data from the timing controller 173*b* to output data signals. The data signals are applied to the output part 172 and applied to data lines through the output part 172. Also, the gate control signal output from the timing controller 173*b* is applied to the gate driver 150 (shown in FIG. 4) through the output part 172.

Figure 6:
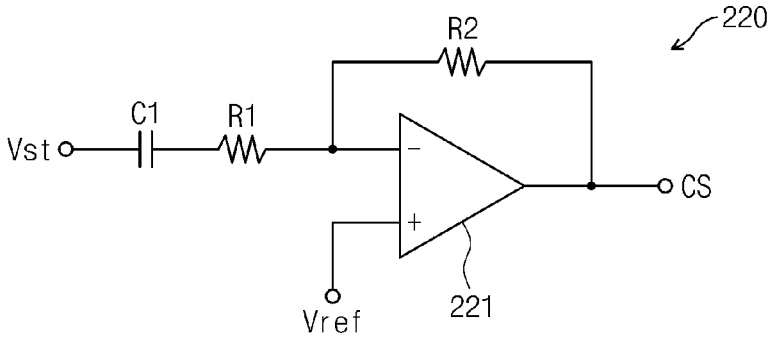
FIG. 6 is a schematic circuit diagram illustrating a voltage compensator of FIG. 1.
Figure 7:
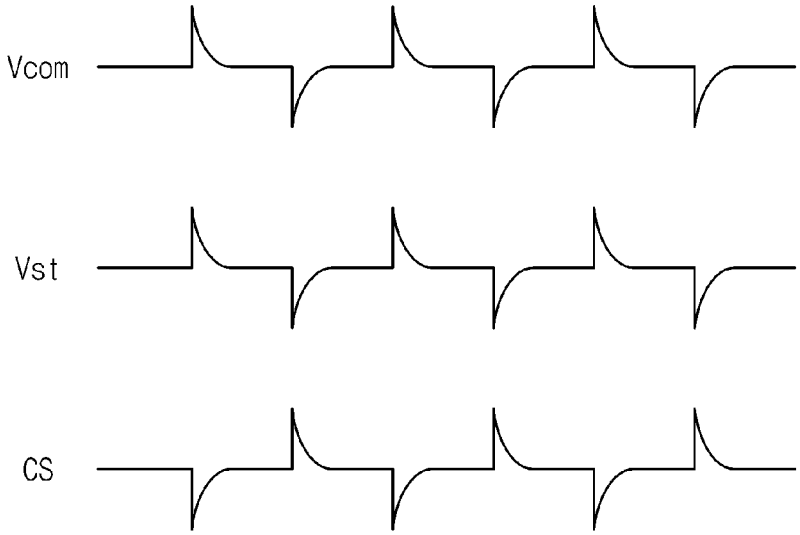
FIG. 7 is a waveforms diagram illustrating a common voltage, a storage voltage, and a compensation signal of the exemplary embodiment of a liquid crystal display panel.

FIG. 6 is an equivalent circuit diagram illustrating an exemplary embodiment of the voltage compensator of FIG. 1, and FIG. 7 is a waveform diagram illustrating the common voltage, the storage voltage, and the compensation signal of the liquid crystal display panel.

Referring to FIGS. 6 and 7, the voltage compensator 220 includes an operational amplifier 221, a capacitor C1, a first resistor R1, and a second resistor R2.

The operational amplifier 221 includes a reverse input terminal (−), a non-reverse input terminal (+), and an output terminal outputting the compensation signal CS. The first resistor R1 is connected to the reverse input terminal (−), and the second resistor R2 is connected between the reverse input terminal (−) and the output terminal. The capacitor C1 is connected to between an input terminal of the voltage compensator 220, which receives the storage voltage Vst from the liquid crystal display panel 100, and the first resistor R1, and a reference voltage Vref is applied to the non-reverse input terminal (+).

When the storage voltage Vst including the ripple component is provided from the liquid crystal display panel 100, a direct current component of the storage voltage Vst is removed by the capacitor C1 and the first resistor R1, so that only the ripple component of the storage voltage Vst is provided to the reverse input terminal (−) of the operational amplifier 221. The operational amplifier 221 compares the ripple component with the reference voltage Vref to output the compensation signal CS having the phase substantially opposite to that of the ripple component.

As illustrated in FIG. 7, the storage voltage Vst and the common voltage Vcom of the liquid crystal display panel 100 include the ripple components that are similar to each other, and the compensation signal CS output from the voltage compensator 220 has the phase opposite to those of the ripple components. Thus, when the compensation signal CS is provided to the liquid crystal display panel 100, the ripple components of the common voltage Vcom and the storage voltage Vst are removed by the compensation signal CS. Thus, the common voltage Vcom and the storage voltage Vst may be compensated, thereby improving display properties by removing, or effectively compensating for, crosstalk.

Figure 8:
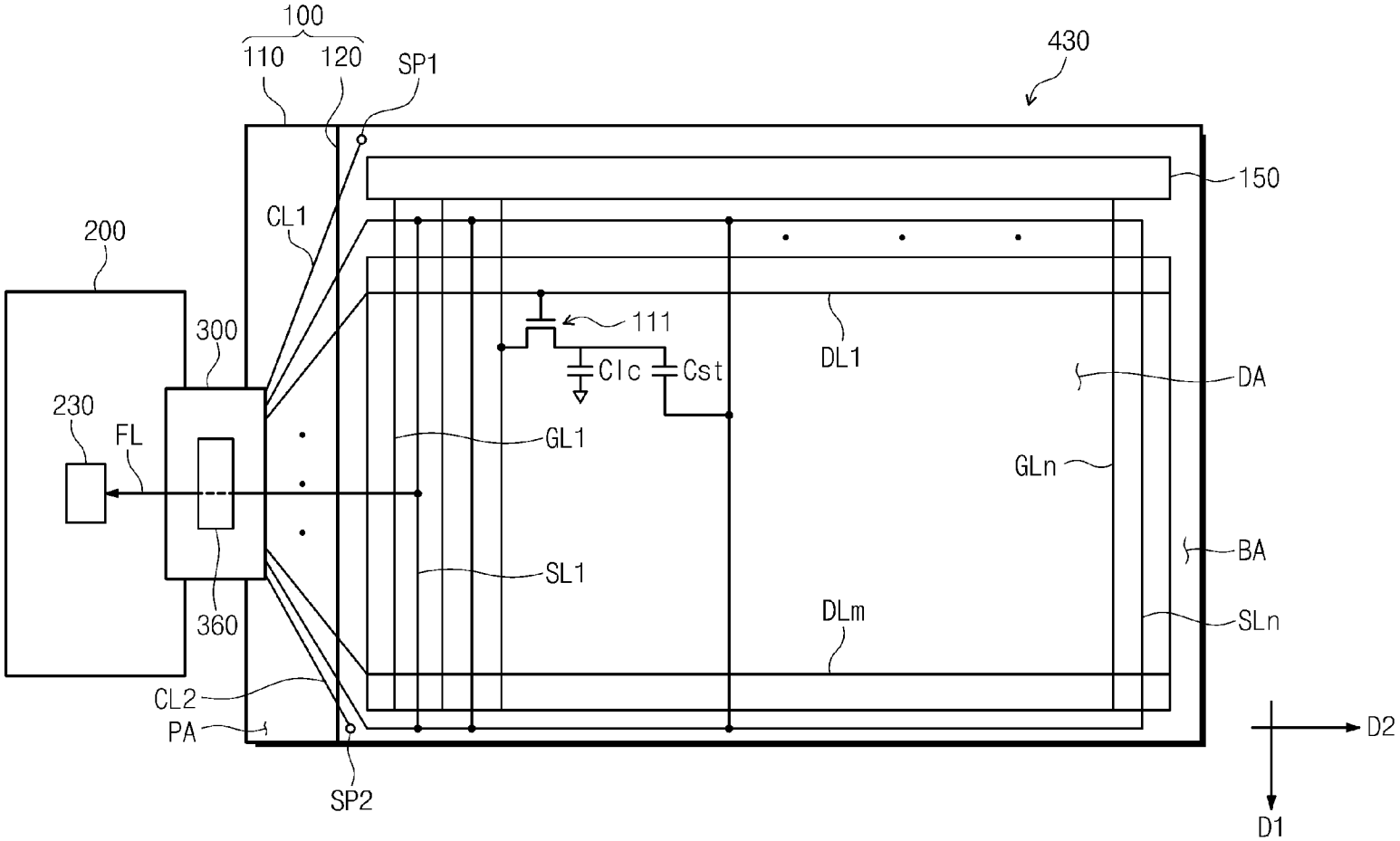
FIG. 8 is a top plan view illustrating another exemplary embodiment of a liquid crystal display according to the present invention.
Figure 9:
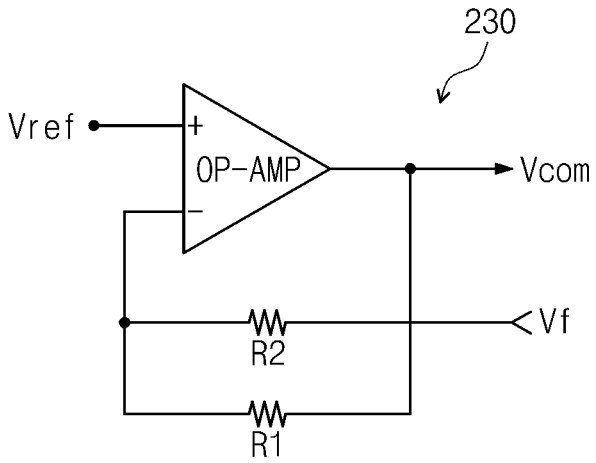
FIG. 9 is an equivalent circuit diagram illustrating a common voltage compensation circuit of FIG. 8.

FIG. 8 is a top plan view illustrating another exemplary embodiment of a liquid crystal display according to the present invention, and FIG. 9 is an equivalent circuit diagram illustrating a common voltage compensation circuit of FIG. 8. In FIG. 8, the same reference numerals denote the same elements in FIG. 1, and thus the detailed descriptions of the same elements will be omitted.

Referring to FIG. 8, a plurality of gate lines GL1~GLn and a plurality of data lines DL1~DLm are arranged in a display area DA of an array substrate 110. The gate lines GL1~GLn extend substantially in parallel along a first direction D1 and are arranged with a substantially uniform interval therebetween. The data lines DL1~DLm extend substantially in parallel along a second direction D2 that is substantially perpendicular to the first direction D1 and are arranged with a substantially uniform interval therebetween. The data lines DL1~DLm are arranged on a different layer from the gate lines GL1~GLn, e.g., they are disposed at a different cross-sectional height from the underlying substrate similar to the exemplary embodiment shown in FIG. 3, and the data lines DL1~DLm are insulated from the gate lines GL1~GLn while crossing the gate lines GL1~GLn.

In the present exemplary embodiment, a liquid crystal display panel 100 has a rectangular-like shape in which a length thereof in the first direction D1 is shorter than a length thereof in the second direction D2, and a number of the gate lines GL1~GLn is much more than a number of the data lines DL1~DLm. That is, in the exemplary embodiment wherein the liquid crystal display panel 100 has a resolution of 1280×800, the number of the gate lines GL1~GLn is 1280, and the number of the data lines is 800.

A gate driver 150 is arranged in a black matrix area BA that is adjacent to a longer side of the liquid crystal display panel 100, and the gate driver 150 is connected to one ends of the gate lines GL1~GLn. Therefore, the gate driver 150 sequentially applies a gate signal to the gate lines GL1~GLn to sequentially scan pixels in a pixel column along the longer side of the liquid crystal display panel 100.

In the present exemplary embodiment, a data driver is integrated in one chip 360 (hereinafter, referred to as a driver IC 360) and mounted on a flexible printed circuit film 300. The driver IC 360 is arranged adjacent to a shorter side of the liquid crystal display panel 100 and electrically connected to the data lines DL1~DLm to apply a data signal to the data lines DL1~DLm.

A printed circuit board 200 is arranged adjacent to the shorter side of the liquid crystal display panel 100, and the printed circuit board 200 is electrically connected to the liquid crystal display panel 100 through the flexible printed circuit film 300. Particularly, a first end portion of the flexible printed circuit film 300 is attached to a peripheral area PA of the liquid crystal display panel 100, and a second end portion of the flexible printed circuit film 300, which is substantially opposite to the first end portion, is attached to the printed circuit board 200. Thus, signals output from the printed circuit board 200 are provided to the driver IC 360 or provided to the gate driver 150 on the liquid crystal display panel 100 through the flexible printed circuit film 300.

An exemplary embodiment of a liquid crystal display 430 further includes a common voltage compensation circuit 230 compensating a common voltage Vcom applied to the liquid crystal display panel 100, a first common voltage line CL1 and a second common voltage line CL2 applying the common voltage Vcom to the liquid crystal display panel 100, and a feedback line FL receiving a panel common voltage Vf fedback from the liquid crystal display panel 100.

In the present exemplary embodiment, the common voltage compensation circuit 230 is arranged on the printed circuit board 200. The common voltage compensation circuit 230 receives the panel common voltage Vf fedback from the liquid crystal display panel 100 and outputs a compensated common voltage Vcom to apply the compensated common voltage Vcom to the liquid crystal display panel 100.

As shown in FIG. 9, the common voltage compensation circuit 230 includes an op-amp, a first resistor R1, and a second resistor R2. A predetermined reference voltage Vref is applied to a non-reverse input terminal (+) of the op-amp, and the first resistor R1 is connected between a reverse input terminal (−) and an output terminal of the op-amp. The second resistor R2 is connected to between the reverse input terminal (−) of the op-amp and a feedback terminal from which the panel common voltage Vf is fedback.

The compensated common voltage Vcom output from the common voltage compensation circuit 230 satisfies Equation 1 as follows:

$$Vcom = Vref - \frac{R1}{R2}(Vf - Vref) \quad \text{< Equation 1 >}$$

As can be seen from the above equation, the compensated common voltage Vcom may be adjusted by a ratio of the first resistor R1 to the second resistor R2.

Meanwhile, a common electrode (not shown) is formed in a color filter substrate 120 of the liquid crystal display panel 100. In the present exemplary embodiment, the common electrode is electrically connected to the first common voltage line CL1 and the second common voltage line CL2 at a first short point SP1 and a second short point SP2, respectively, that are formed in the black matrix area BA of the liquid crystal display panel 100 to receive the compensated common voltage Vcom. Although not shown in FIGS. 8 and 9, a first conductive spacer (not shown) and a second conductive spacer (not shown) are arranged at the first and second short points SP1 and SP2, respectively, to electrically connect the common electrode to the first and second common voltage lines CL1 and CL2. Alternative exemplary embodiments include configurations wherein the number and arrangement of short points SP1 and SP2 may be varied.

In the present exemplary embodiment, the first short point SP1 is arranged adjacent to an area where a first gate line GL1 crosses a first data line DL1, and the second short point SP2 is arranged adjacent to an area where the first gate line GL1 crosses an m-th data line DLm.

In the present exemplary embodiment, the feedback line FL is connected to a first storage line SL1 among a plurality of storage lines SL1~SLn to receive a storage voltage Vst and provide the storage voltage Vst to the common voltage compensation circuit 230. The feedback line FL is electrically connected to a feedback terminal of the common voltage compensation circuit 230 arranged in the printed circuit board 200 via the flexible printed circuit film 300 and the driver IC 360 in a similar manner as described above with respect to the previous exemplary embodiments.

Figure 10:
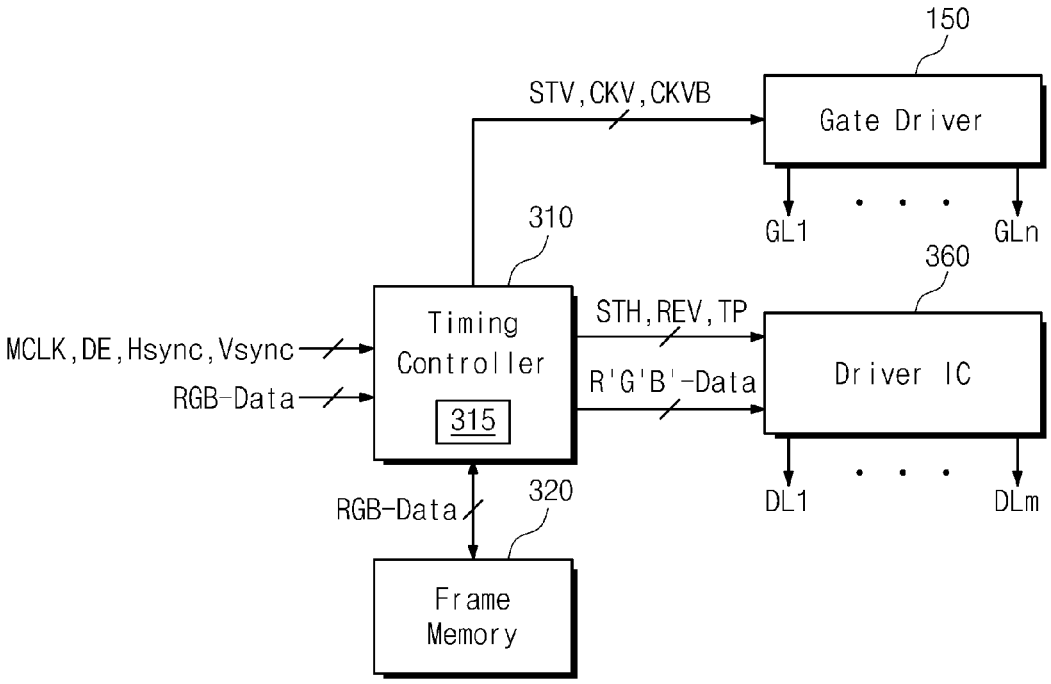
FIG. 10 is a block diagram illustrating a driving circuit of the exemplary embodiment of a liquid crystal display of FIG. 8.

FIG. 10 is a block diagram illustrating an exemplary embodiment of a driving circuit of the liquid crystal display of FIG. 8.

Referring to FIG. 10, a driving circuit of the liquid crystal display 430 includes a timing controller 310, a frame memory 320, the gate driver 150, and the driver IC 360.

In the present exemplary embodiment, the timing controller 310 receives a data enable signal DE, a vertical synchronization signal Vsync, a horizontal synchronization signal Hsync, a main clock signal MCLK, and a first image data RGB-data from an external device. The timing controller 310 sequentially stores the first image data RGB-data from the external device into the frame memory 320. The timing controller 310 includes a data converter 315 that reads out the first image data RGB-data stored in the frame memory 320 and converts the read-out first image data RGB-data into a second image data R'G'B'-data. The second image data R'G'B'-data output from the data converter 315 is provided to the driver IC 360.

Figure 11:
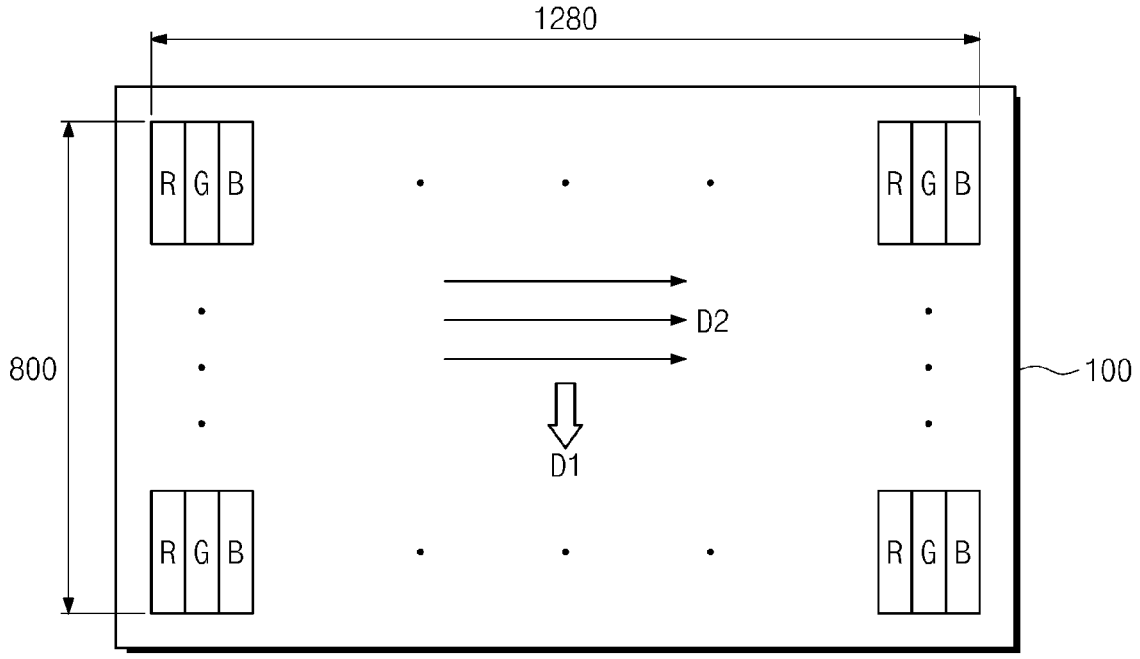
FIG. 11 is a top plan schematic view illustrating an input order of the first image data.
Figure 12:
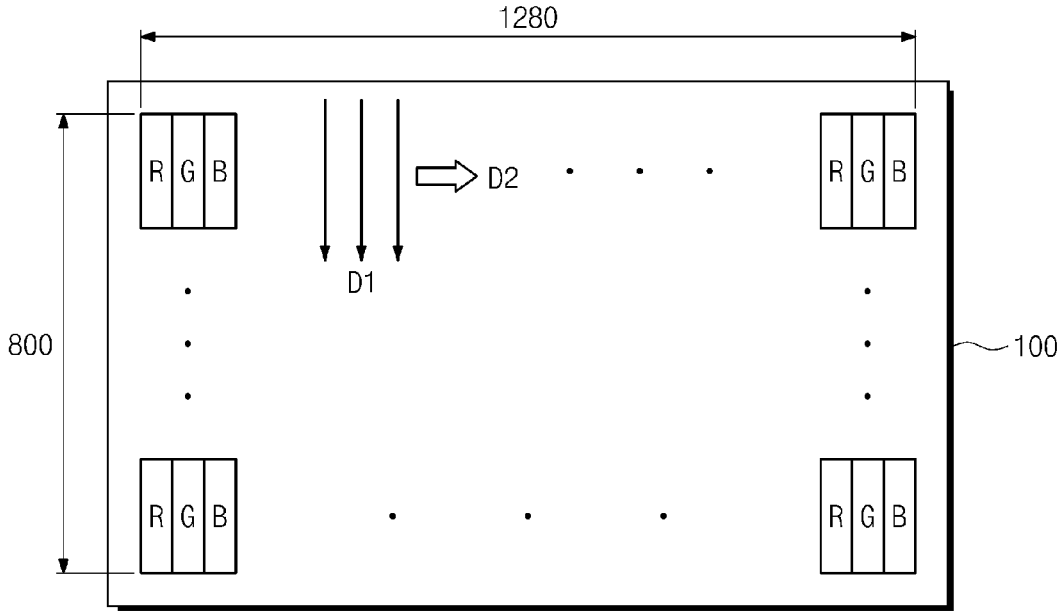
FIG. 12 is a top plan schematic view illustrating an input order of the second image data.

FIG. 11 is a top plan schematic view illustrating an input order of the first image data, and FIG. 12 is a top plan schematic view illustrating an input order of the second image data. For the convenience of explanation, an exemplary embodiment of the liquid crystal display panel 100 will be described wherein the liquid crystal display panel 100 has a resolution of 1280×800, although alternative exemplary embodiments may include configurations having a different resolution.

Referring to FIG. 11, the first image data RGB-data is a data group in which the first image data RGB-data are input in a pixel row. In the present exemplary embodiment, the pixel row is defined as a group of pixels arranged in the second direction D2.

More particularly, in the present exemplary embodiment the first image data RGB-data is the data group that begins from a first pixel row in which R(1,1), G (1,1), B(1,1), R(2,1), G(2,1), B(2,1), . . . R(1280,1), G(1280,1), and B(1280,1) are arranged and gradually increases in the second direction D2 to a last pixel row in which R(1,800), G(1,800), B(1,800), R(2,800), G(2,800), B(2,800), . . . R(1280,800), G(1280, 800), and B(1280,800) are arranged, wherein the first coordinate represents a pixel number along the second direction D2 and the second coordinate represents a pixel number along the first direction D1.

As shown in FIG. 12, the second image data R'G'B'-data converted by the data converter 315 is a data group, in which the second image data R'G'B'-data are input in a pixel column. The pixel column is defined as a group of pixels arranged in the first direction D1.

More particularly, the second image data R'G'B'-data is the group of data that begins from a first pixel column in which R(1,1), R(1,2), R(1,3), R(1,4), R(1,5), R(1,6) . . . R(1,798), R(1,799), and R(1,800) are arranged and gradually increases in the first direction D1 to a last pixel column in which B(1280,1), B(1280,2), B(1280,3) B(1280,4), B(1280,5), B(1280,6), . . . B(1280,798), B(1280,799), and B(1280,800) are arranged.

As illustrated in FIG. 8, since the gate driver 150 is arranged adjacent to a longer side of the liquid crystal display panel 100 and the driver IC 360 is arranged adjacent to a shorter side of the liquid crystal display panel 100, the liquid crystal display panel 100 is scanned in the second direction D2, e.g., the gate lines GL1-GLn are activated sequentially from left to right, or alternatively right to left. Thus, the timing controller 310 coverts the first image data RGB-data from the external device into the second image data R'G'B'-data that is appropriate for the scan direction D2 to provide the second image data R'G'B'-data to the driver IC 360.

Referring again to FIG. 10, the timing controller 310 generates a data control signal and a gate control signal using the data enable signal DE, the main clock signal MCLK, the vertical synchronization signal Vsync, and the horizontal synchronization signal Hsync and outputs the data control signal and the gate control signal to the driver IC 360 and the gate driver 150, respectively.

The driver IC 360 outputs a plurality of data signals to the data lines DL1~DLm in response to the data signal and the second image data R'G'B'-data from the timing controller 310. In the present exemplary embodiment, the data control signal includes a horizontal start signal STH, a reverse signal REV, and an output start signal TP. The horizontal start signal STH starts an operation of the driver IC 360, the reverse signal REV reverses a polarity of the data signals, and the output start signal TP decides an output timing of the data signals from the driver IC 360.

The gate driver 150 sequentially outputs gate signals GS1~GSn to the gate lines GL1~GLn in response to the gate control signal provided from the timing controller 310. In the present exemplary embodiment, the gate control signal includes a vertical start signal STV, a first clock signal CKV, and a second clock signal CKVB. The vertical start signal STV starts an operation of the gate driver 150, and the first and second clock signals CKV and CKVB decide an output timing of the gate signals GS1~GSn applied to the gate lines GL1-GLn, respectively.

Figure 13:
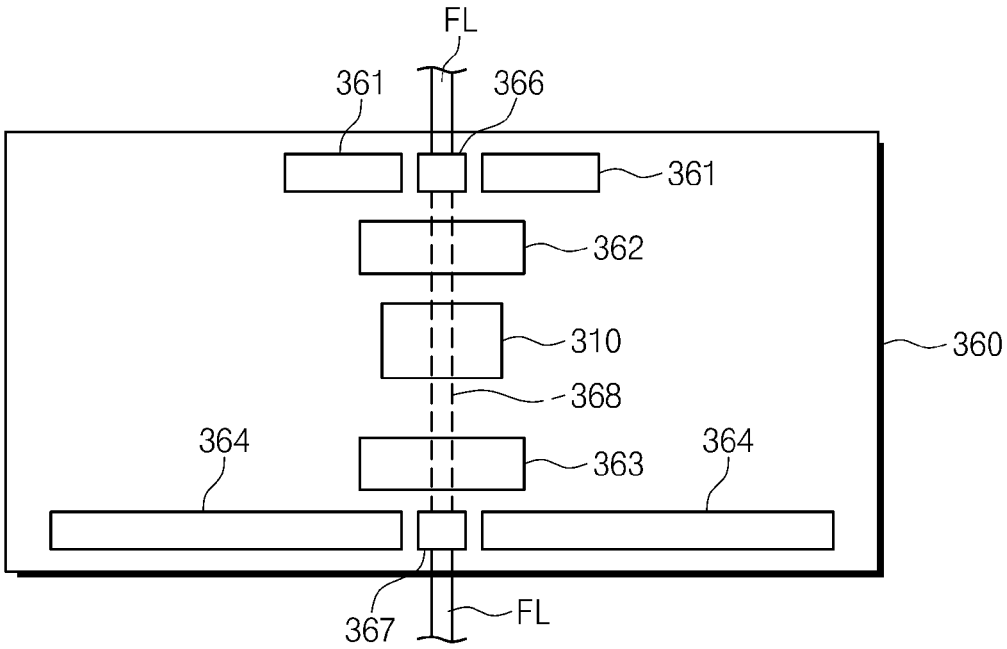
FIG. 13 is a block diagram illustrating an exemplary embodiment of a driver IC according to the present invention.

FIG. 13 is a block diagram illustrating an exemplary embodiment of a driver IC according to the present invention.

Referring to FIG. 13, a receiver 362, a timing controller 310, and a data driver 363 are arranged inside a driver IC 360. An input part 361 including input terminals and an output part 364 including output terminals are arranged along lateral sides of the driver IC 360. In the present exemplary embodiment, the driver IC 360 has a rectangular-like shape, although alternative exemplary embodiments include configurations wherein the driver IC 360 has various other shapes. The input part 361 is arranged adjacent to one longer side thereof and the output part 364 is arranged adjacent the other longer side thereof opposite to the first side thereof.

A first dummy terminal 366 is arranged in the middle of the input part 361, and a second dummy terminal 367 is arranged in the middle of the output part 364. The first and second dummy terminals 366 and 367 are arranged in lateral sides of the driver IC 360 and electrically connected to a feedback line FL that is divided into at least two portions about the driver IC 360. In addition, the first and second dummy terminals 366 and 367 are electrically connected to each other through an inner interconnection 368 provided inside the driver IC 360. Thus, the divided portions of the feedback line FL are electrically connected to each other through the first dummy terminal 366, the second dummy terminal 367, and the inner interconnection 368.

In the present exemplary embodiment, the receiver 362, the timing controller 310, and the data driver 363 are arranged between the input part 361 and the output part 364.

The receiver 362 receives various signals from the external device, e.g., by a low voltage differential signaling ("LVDS") interface, to provide the timing controller 310 with the various signals. As shown in FIG. 10, exemplary embodiments of signals provided to the timing controller 310 includes the first image data RGB-data, the data enable signal DE, the main clock signal MCLK, the vertical synchronization signal Vsync, and the horizontal synchronization signal Hsync.

The timing controller 310 outputs the gate control signal, the data control signal, and the second image data R'G'B'-data (shown in FIG. 10). The data driver 363 receives the data control signal and the second image data R'G'B'-data from the timing controller 310 to output the data signals. The data signals are provided to the output part 364 and applied to the data lines through the output part 364. Also, the gate control signal output from the timing controller 310 is provided to the gate driver 150 (shown in FIG. 9) through the output part 364.

Although not shown in figures, in one exemplary embodiment, the frame memory 320 shown in FIG. 10 may be disposed in the driver IC 360.

As described above, since circuits, such as the receiver 362, the timing controller 310, the frame memory 320, are disposed in the driver IC 360, a number of circuit parts for the liquid crystal display 430 may be reduced.

In FIG. 8, an exemplary embodiment wherein a structure that the driver IC 360 is arranged on the flexible printed circuit film 300 has been shown, but alternative exemplary embodiments include configurations wherein the driver IC 360 may be mounted on the peripheral area PA of the liquid crystal display panel 100.

According to the above, in a structure that the data driver is integrated in one chip, the voltage compensator receives the storage voltage fedback from the storage line arranged in the liquid crystal display panel and generates the compensation signal to compensate for the common voltage. Thus, crosstalk caused by a ripple in the common voltage may be removed, thereby improving image display quality.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a data driver which is integrated in one chip;

a gate driver which sequentially outputs a gate signal;

a display panel comprising:

a data line which receives data signals;

a gate line which receives the gate signal; and a pixel which is connected to the gate line and the data line;

a voltage generator which generates a common voltage and a storage voltage and provides the display panel with the common voltage and the storage voltage through a common voltage line and a plurality of storage lines, respectively;

a voltage compensator which receives the storage voltage feedback from the display panel and generates a compensation signal to compensate the common voltage based on the feedback storage voltage; and a feedback line which provides the voltage compensator with the storage voltage, and the feedback line electrically connected to the voltage compensator through the data driver, wherein the data driver outputs all of the data signals;

wherein the feedback line is electrically connected to a middle position of a storage line that is most adjacent to the one chip among the plurality of storage lines.

2. The display apparatus of claim 1, further comprising:

a printed circuit board which includes the voltage generator and the voltage compensator; and a flexible printed circuit film which electrically connects the printed circuit board and the display panel.

3. The display apparatus of claim 2, wherein the feedback line extends to the printed circuit board via the flexible printed circuit film and is electrically connected to the voltage compensator through the flexible printed circuit film.

4. The display apparatus of claim 3, wherein the data driver is integrated in the chip which is mounted on the flexible printed circuit film, and the feedback line overlaps the chip on the flexible printed circuit film.

5. The display apparatus of claim 3, wherein the chip is mounted on the display panel and the feedback line overlaps the chip on the display panel.

6. The display apparatus of claim 1, wherein a blank area is provided on a lower surface of the chip corresponding to the feedback line, and the chip comprises a plurality of terminals arranged in a remaining area of the lower surface outside of the blank area.

7. The display apparatus of claim 1, wherein the chip comprises:

first dummy terminals and second dummy terminals electrically connected to the feedback line; and an interconnection arranged along the chip to electrically connect the first dummy terminal and the second dummy terminal.

8. The display apparatus of claim 1, wherein the display panel further comprises:

at least one common voltage line which receives the common voltage from the voltage generator;

a common electrode which receives the common voltage through the common voltage line; and a plurality of storage lines which receive the storage voltage from the voltage generator, wherein the feedback line is electrically connected to at least one of the storage lines.

9. The display apparatus of claim 8, wherein the feedback line branches from a single storage line, which is closest to the chip, among the plurality of storage lines.

10. The display apparatus of claim 8, wherein the compensation signal output from the voltage compensator is applied to the common voltage line and the plurality of storage lines.

11. The display apparatus of claim 1, wherein the storage voltage and the common voltage are direct current voltage signals, and the compensation signal has a phase substantially opposite to a phase of a ripple component of the storage voltage.

12. The display apparatus of claim 11, wherein the voltage compensator comprises:

a capacitor which receives the storage voltage;

a first resistor connected to the capacitor;

an operational amplifier including a reverse input terminal connected to the first resistor, a non-reverse input terminal which receives a reference voltage, and an output terminal which outputs the compensation signal; and a second resistor connected between the reverse input terminal and the output terminal.

13. A display apparatus comprising:

a data driver which is integrated in one chip;

a gate driver which sequentially outputs gate signals;

a display panel comprising:

a plurality of data lines which receive data signals;

a plurality of gate lines which receive the gate signals; and a plurality of pixels each of which is connected to a corresponding gate line of the plurality of gate lines and a corresponding data line of the plurality of data lines;

a voltage generator which generates a common voltage and a storage voltage and provides the display panel with the common voltage and the storage voltage through a common voltage line and a plurality of storage lines, respectively;

a voltage compensator which receives the storage voltage feedback from the display panel and generates a compensation signal to compensate the common voltage based on the feedback storage voltage; and a feedback line which provides the voltage compensator with the storage voltage, the feedback line electrically connected to the voltage compensator through the chip, wherein the plurality of gate lines extend in a first direction, the plurality of data lines extend in a second direction substantially perpendicular to the first direction, the display panel has a structure wherein a length thereof in the first direction is longer than a length thereof in the second direction, and a number of the plurality of gate lines is more than a number of the plurality of data lines;

wherein the data driver outputs all of the data signals;

wherein the feedback line is electrically connected to a middle position of a storage line that is most adjacent to the one chip among the plurality of storage lines.

14. The display apparatus of claim 13, wherein the gate driver comprises a plurality of amorphous silicon type transistors, which are disposed directly on the display panel and adjacent to a shorter side of the display panel, and wherein the gate driver sequentially scans the plurality of pixels in a pixel row along the shorter side of the display panel, and the chip is arranged adjacent to a longer side of the display panel and outputs the data signals to the plurality of pixels in the pixel row which is scanned by the gate signal.

15. The display apparatus of claim 14, wherein each of the plurality of pixels has a structure wherein a length thereof in the first direction is longer than a length thereof in the second direction.

16. The display apparatus of claim 13, wherein a blank area is provided on a lower surface of the chip corresponding to the feedback line, and the chip comprises a plurality of terminals arranged in a remaining area of the lower surface outside of the blank area.

17. A display apparatus comprising:

a data driver which is integrated in one chip;

a gate driver which sequentially outputs gate signals;

a display panel comprising:

a plurality of data lines which receive data signals;

a plurality of gate lines which receive the gate signals;

a plurality of pixels each of which is connected to a corresponding gate line of the plurality of gate lines and a corresponding data line of the plurality of data lines;

a voltage generator which generates a common voltage and a storage voltage and provides the display panel with the common voltage and the storage voltage through a common voltage line and a plurality of storage lines, respectively;

a voltage compensator which receives the storage voltage feedback from the display panel and generates a compensation signal to compensate the common voltage based on the feedback storage voltage; and a feedback line which provides the voltage compensator with the storage voltage, the feedback line electrically connected to the voltage compensator through the chip, wherein the plurality of gate lines extend in a first direction, the plurality of data lines extend in a second direction substantially perpendicular to the first direction, the display panel has a structure wherein a length thereof in the second direction is longer than a length thereof in the first direction, and a number of the plurality of gate lines is more than a number of the plurality of data lines, wherein the data driver outputs all of the data signals;

wherein the feedback line is electrically connected to a middle position of a storage that is most adjacent to the one chip among the plurality of storage lines.

18. The display apparatus of claim 17, wherein the gate driver comprises a plurality of amorphous silicon type transistors, which are disposed directly on the display panel and adjacent to a longer side of the display panel, and wherein the gate driver sequentially scans the plurality of pixels in a pixel column along the longer side of the display panel, and the chip is arranged adjacent to a shorter side of the display panel and outputs the data signals to the plurality of pixels in the pixel column which is scanned by the gate signal.

19. The display apparatus of claim 18, wherein each of the plurality of pixels has a structure wherein a length thereof in the first direction is longer than a length thereof in the second direction.

20. The display apparatus of claim 18, further comprising a timing controller which controls the gate driver and the data driver, and wherein the timing controller comprises a data converter which converts a first image data sequentially input from an exterior corresponding to a pixel row into a second image data corresponding to the pixel column and sequentially provides the second image data to the data driver.

21. A display apparatus comprising:

a data driver which is integrated in one chip;

a gate driver which sequentially outputs a gate signal;

a display panel comprising:

a plurality of data lines which receives data signals;

a plurality of gate lines which receives the gate signal;

a plurality of storage lines which receives a storage voltage; and a pixel which is connected to the gate line and the data line;

a voltage generator which generates a common voltage and the storage voltage and provides the display panel with the common voltage and the storage voltage through a common voltage line and the plurality of storage lines, respectively;

a voltage compensator which receives the storage voltage feedback from the display panel and generates a compensation signal to compensate the common voltage based on the feedback storage voltage; and a feedback line which provides the voltage compensator with the storage voltage, and the feedback line electrically connected to the voltage compensator through the data driver, wherein the feedback line is disposed between two data lines adjacent to each other and branches from a single storage line, which is closest to the chip, among the plurality of storage lines, wherein the data driver outputs all of the data signals;

wherein the feedback line is electrically connected to a middle position of a storage line that is most adjacent to the one chip among the plurality of storage lines.

* * * * *